US006489548B1

(12) United States Patent
Schindler

(10) Patent No.: US 6,489,548 B1
(45) Date of Patent: Dec. 3, 2002

(54) STRING CHANGING ASSIST APPARATUS AND METHOD

(76) Inventor: Edward C. Schindler, 805 Stillhouse Spring, Round Rock, TX (US) 78681

( * ) Notice: Subject to any disclaimer, the term of this patent is extended or adjusted under 35 U.S.C. 154(b) by 0 days.

(21) Appl. No.: 09/850,278

(22) Filed: May 7, 2001

(51) Int. Cl.[7] ..... G10G 7/00

(52) U.S. Cl. ..... 84/453; 84/454; 84/455; 84/458; 84/197

(58) Field of Search ..... 84/453, 454, 455, 84/458, 197

(56) References Cited

U.S. PATENT DOCUMENTS

| | | | | | |
|---|---|---|---|---|---|
| ,341,846 | A | | 5/1886 | Home | 73/862.471 |
| 3,392,621 | A | | 7/1968 | Pease | 84/454 |
| 3,443,467 | A | | 5/1969 | Richards | 84/301 |
| 3,494,240 | A | * | 2/1970 | Laselva et al. | 84/291 |
| 4,165,670 | A | * | 8/1979 | Cahn | 84/318 |
| 5,277,094 | A | * | 1/1994 | Spuler | 84/298 |
| 6,107,556 | A | | 8/2000 | Gilliam | 84/454 |
| 6,297,434 | B1 | * | 10/2001 | Martello | 84/298 |

* cited by examiner

*Primary Examiner*—Shih-Yung Hsieh
(74) *Attorney, Agent, or Firm*—J. Nevin Shaffer, Jr.; Shaffer & Culbertson, LLP

(57) ABSTRACT

A string assist apparatus and method (10) includes a support (12) and a resilient extension (14) connected to the support (12). When placed in position on an instrument (20), one end (18) of a string (16) is connected to a bridge (22). The string (16) is passed over the top of resilient extension (14) and connected to tuning post (26). As string (16) is wound around tuning post (26) tension is applied by resilient extension (14) keeping the end (18) of string (16) in place on bridge (22) and freeing both user's hands to attend to the winding process. A connector (42) for removably attaching the invention to the instrument (20) and a height adjuster (62) for adjusting the height of the resilient extension (14) are also provided.

20 Claims, 4 Drawing Sheets

STRING CHANGING ASSIST APPARATUS AND METHOD

TECHNICAL FIELD OF THE INVENTION

This invention relates to a string changing assist apparatus and method. In particular, this invention relates to an apparatus and method for assisting in the changing of strings for musical instruments.

BACKGROUND OF THE INVENTION

Stringed instruments require frequent tunning and adjustment. Inevitably, strings wear out or break and require replacement. The procedure for correctly replacing these strings is more of an art form than a purely mechanical act. In the typical stringed instrument, a guitar for example, one end of the string is first attached to the guitar by a guitar bridge. This end of the string typically has a metal bead or ball that fits into the bridge in a variety of ways, but which is held in place by tension on the string. In other cases, the guitar string has no metal ball and the end is wound around itself and only string tension holds the string in place. This tension requirement is the cause of most of the difficulty in restringing an instrument. The difficulty is that a person only has two hands and the job requires three: one to keep tension on the bead, or tied end, in the bridge, one to guide the string as it is wound around the tuning post and one to turn the tuning knob. A further complicating factor is that a proper wind about the tuning post requires the tuner to leave slack in the string so that when properly installed there is just the right amount of string on the post: not too little, which would not allow the string to catch properly on the tuning post, and not too much, which would create bulky, unstable windings.

The issue of properly stringing and tuning instruments is not a new one. A variety of prior art devices have attempted to solve tuning problems once the string has been attached. An early tuner device is disclosed in the Home patent, U.S. Pat. No. 341,846. More recent patents have issued for string tuners as shown in the Pease patent, U.S. Pat. No. 3,392,621, and the Richards patent, U.S. Pat. No. 3,443,467.

The applicant is also aware of one device for which a patent issued, U.S. Pat. No. 6,107,556 to Gilliam, that helps a user apply tension to the string with a single hand.

Nonetheless, the applicant is aware of no device or method that frees both of the user's hands to attend to the critical winding job while applying tension to the string and at the same time allowing for an appropriate amount of extra string or slack in the string.

Thus, there is a need in the art for providing an apparatus and method for assisting an individual in stringing an instrument that frees both of the individual's hands to attend to the winding of the string on the tuning post. It, therefore, is an object of this invention to provide an apparatus and method for assisting in the stringing of instruments such that both of a user's hands are free to ensure the string is properly wound on the tuning post while at the same time applying appropriate tension to the string, and providing an adequate amount of slack in the string.

SHORT STATEMENT OF THE INVENTION

Accordingly, the string changing assist apparatus of the present invention includes a support and a resilient extension connected to the support. In a preferred embodiment of the invention, a connector is added for removably attaching the support to an instrument. In another preferred embodiment, the connector is a pair of hook and loop straps. In yet another preferred embodiment, the resilient extension includes a height adjuster. In another preferred embodiment, the resilient extension is a three sided form with an expandable base. In a preferred embodiment the three sided form is a triangle of four pieces, two pieces forming extended sides of the triangle and two pieces overlapping and forming the expandable base.

In still another preferred embodiment, the resilient extension is an L-shaped arm. In another preferred embodiment, an article receiver is connected to the apparatus for removably attaching articles to the apparatus.

In another preferred embodiment, the support and the resilient extension is the top of an inverted V-shaped wedge. In another preferred embodiment, a tension adjuster is provided for the inverted V-shaped wedge.

A preferred embodiment of the method of the invention includes the steps of constructing a support and connecting a resilient extension, movable between an extended and a collapsed position, to the support. Next, the support and resilient extension, in the extended position, is placed on an instrument. Then, one end of a string is attached to the instrument and the string is passed over the resilient extension in the extended position. Then, an individual is free to use both hands to insert the other end of the string into the tuning post and wind the string around the post under tension from the resilient extension.

In another preferred embodiment of the method, the step of adding a connector for removably connecting the support to the instrument is provided. In yet another preferred embodiment, a height adjuster is added to the resilient extension.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
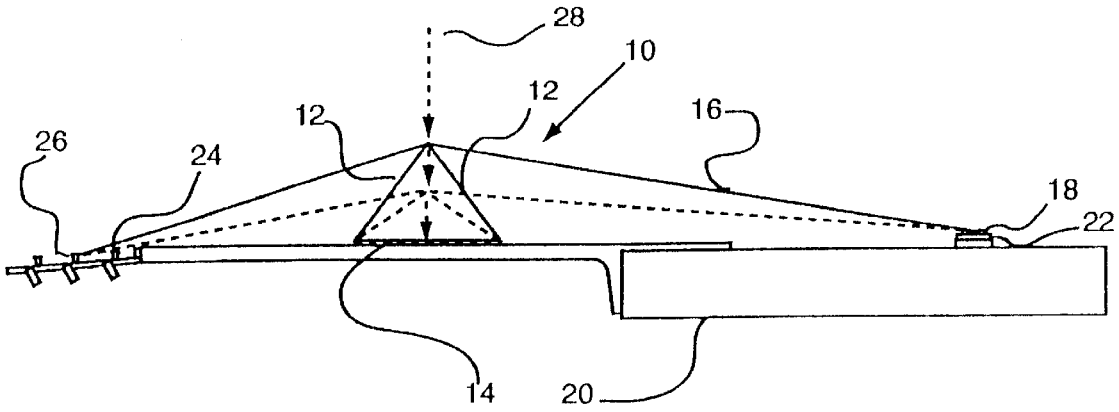
FIG. 1 is a side perspective view of the string changing assist apparatus of the present invention in its extended position and, in dotted lines, in a collapsed position.

The preferred embodiment of the present invention is illustrated by way of example in FIGS. 1–9. With reference to FIG. 1, a string assist apparatus 10 includes a support 12 and a resilient extension 14 connected to support 12. String 16 is shown with one end 18 connected to instrument 20 by means of bridge 22. One end 18 is connected to the bridge 22, the string 16 is passed over resilient extension 14 and the other end 24 of string 16 is connected to tuning post 26. At this point, string 16 is tensioned by string assist apparatus 10. This tension assists in keeping end 18 of string 16 in place in its attachment to bridge 22. Further the height of string assist apparatus 10 adds the extra length needed for proper winding while still keeping the string 16 under tension. This extra length is the "slack" needed in all cases of string attachment, but which causes end 18 to slip from bridge 22 if not kept under tension.

FIG. 1 further illustrates the operation of the string assist apparatus 10 of the present invention by showing what happens as string 16 is wound around tuning post 26. The dotted lines show that as string 16 is wound, string assist apparatus 10 is compressed in the direction of arrows 28. That is, as the extra length, slack, is taken out of string 16 by winding it around tuning post 26, resilient extension 14 is collapsed incrementally, all the while continuing to exert upward pressure in the direction opposite to arrows 28 on string 16, thus keeping tension on string 18 throughout the entire string attachment process.

Figure 2:
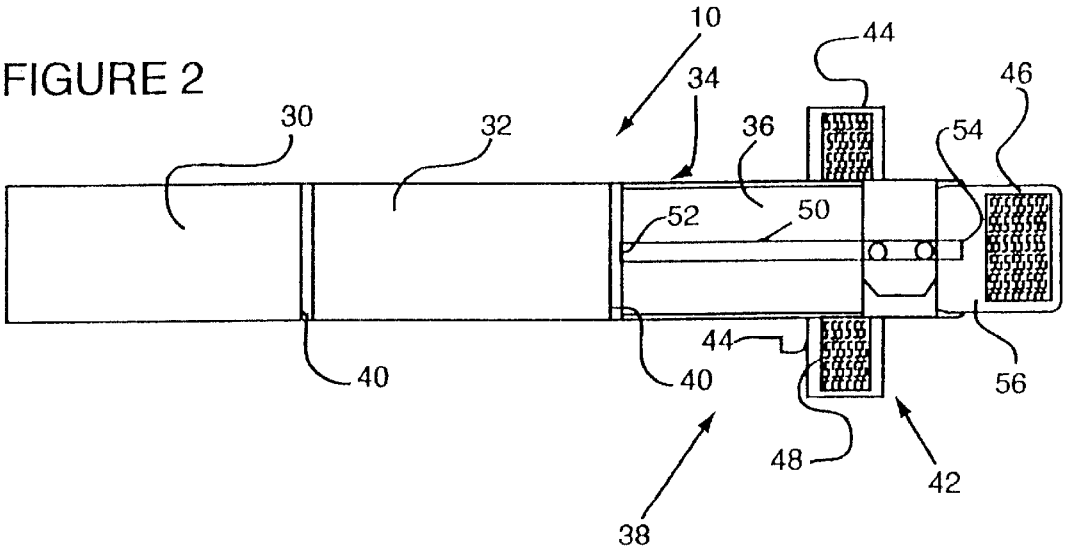
FIG. 2 is a top view of a preferred embodiment of the invention of FIG. 1 in its unfolded position.
Figure 3:
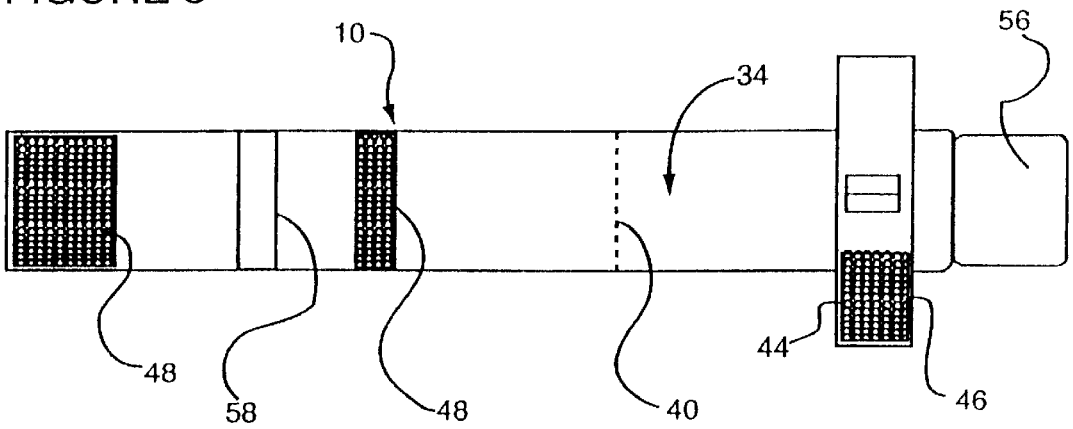
FIG. 3 is a bottom view of the invention illustrated in FIG. 2.

Referring now to FIGS. 2 and 3, a preferred embodiment of the invention is illustrated. In this embodiment, first extension 30 is connected to second extension 32. Lower base 34 (not shown) is connected to second element 32 and upper base 36 lies on top of lower base 32 thereby forming expandable base 38. Connecting substrate 40 is used to connect first extension 30, second extension 32 and lower base 34. Connection substrate 40, in a preferred embodiment, includes connector 42 for removably connecting string assist apparatus 10 to instrument 20. In a preferred embodiment, connector 42 includes a pair of arms 44 with hook material 46 and loop material 48.

FIG. 2 also illustrates stretchable, resilient, locator 50 with two ends, 52 and 54. End 52 is connected to connecting substrate 40. End 54 is connected to upper base substrate 56. Upper base substrate 56 has hook material 46 as shown.

FIG. 3 shows lower base 34 in dotted lines as attached to, and covered by, connecting substrate 40. FIG. 3 also shows loop material 48 and hook material 46 on connecting substrate 40 in the proper places to cooperate in the use of the invention as will be disclosed hereafter. FIG. 3 also shows attachment 58 for use in attaching items to the invention as will also be disclosed more fully hereafter.

Figure 4:
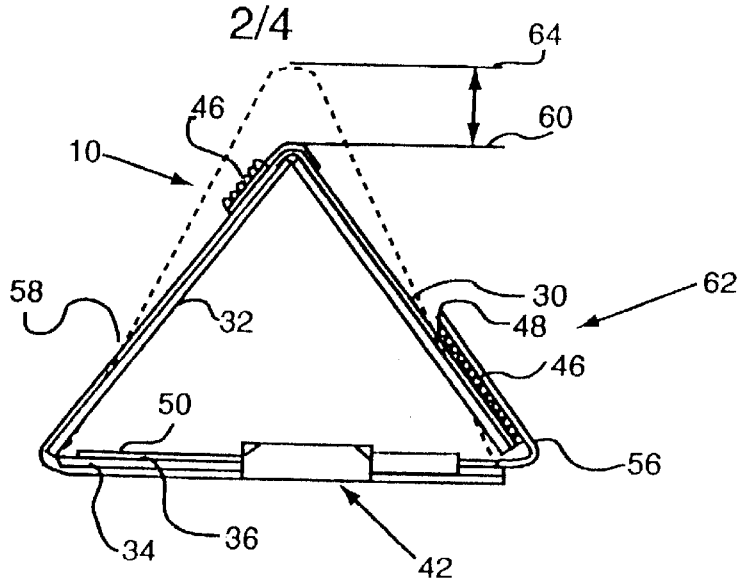
FIG. 4 is a side view of the invention as illustrated in FIGS. 2 and 3 in its assembled and extended position and with dotted lines showing the height adjustment feature of the invention.
Figure 5:
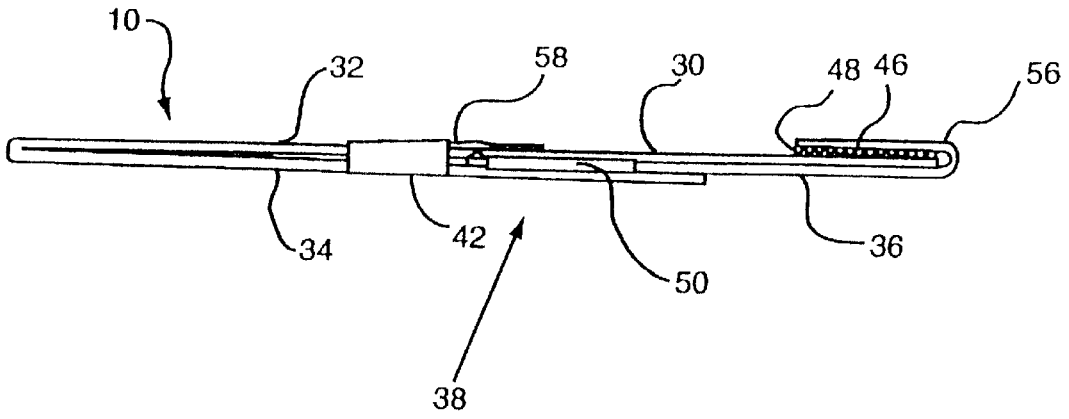
FIG. 5 is a side view of the invention illustrated in FIG. 4 shown in its fully collapsed position.

Referring now to FIGS. 4 and 5, the operation of the string assist apparatus 10 is more fully described. FIG. 4 shows the invention in the assembled and extended position. In this extended position, the invention has a height 60 which is achieved from the position illustrated in FIG. 2 by lifting first extension 30 up and bending it over to the end 54 of stretchable, resilient locator 50. There loop material 48 on the back of first extension 30 cooperates, as is known in the art, with hook material 46 on upper base substrate 56 to form height adjuster 62. Height adjuster 62, in a preferred embodiment, works as shown in the dotted lines in FIG. 4. That is, upper base substrate 56 having hook material 56 is pulled away from loop material 48 on the back of the connecting substrate where it covers first extension 30. First extension 30 is then lifted thereby increasing the height of the invention from height 60 to height 64 and the hook material 46 is reattached to the loop material 48, as shown in the dotted lines.

Referring to FIG. 5, the string assist apparatus 10 is shown in its fully collapsed position as is the case when string 16 is properly attached to the tuning post 26. In this collapsed position, expandable base 38 is expanded completely and stretchable, resilient locator 50 is stretched. It is the nature of stretchable resilient locator 50 to resist stretching and to attempt to return upper base 36 to position approximately on top of lower base 34 as shown in FIG. 4, for example. For the purposes of the invention, stretchable, resilient locator 50 may be made of any stretchable, resilient material that tends to return to its previous position after stretching, such as rubber, elastic, and so forth. Because of the stretchable, resilient locator 50 in this embodiment of the invention, the downward force in the direction of arrows 28 in FIG. 1 is constantly resisted by upward force, thereby keeping tension on string 16 throughout the stringing process. After stringing, string assist apparatus 10 in the collapsed position is simply slid out from underneath the string 16 and removed.

It is not always necessary to physically attach the invention to an instrument 20. If the instrument 20 is being restrung on a horizontal surface, string assist apparatus 10 is simply placed directly on the instrument 20, including other strings that have already been attached, and operated as illustrated. Should the instrument 20 need to be restrung while in a non-horizontal location, however, connector 42 is used. The pair of arms 44 are opened and wrapped around the instrument 20. Hook material 46 and loop material 48 then cooperate together to hold the invention in place. Once restringing is completed, the arms 44 are separated and the invention is removed as described above. Obviously, any type of convenient connector other than hook and loop material now known or hereafter developed is included within the scope of the present invention.

Figure 6:
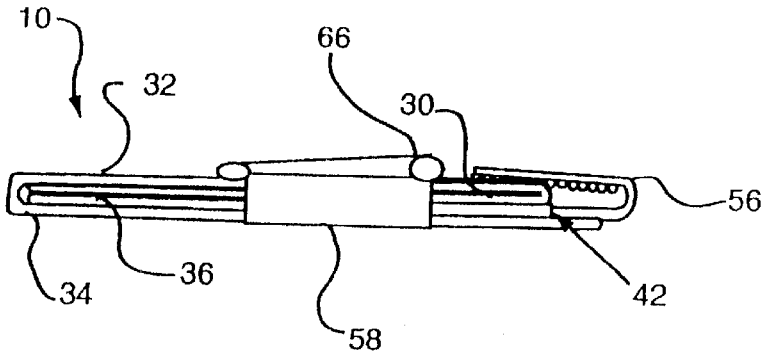
FIG. 6 is a side view of the invention illustrated in FIG. 5 shown in its folded position.

Referring now to FIG. 6, the string assist apparatus 10 as previously illustrated in FIGS. 2–5, is shown in the compact folded position. To fold the invention in this embodiment, upper base substrate 56 is detached from first extension 30. First extension 30 is then folded on to second extension 32 and then the two are folded on top of stretchable locator 50 and upper base 36. Upper base substrate 56 is then pressed into connection with the loop material 48 on the connecting substrate 40 covering second extension 32 so that the invention is firmly held in this folded position.

FIG. 6 also demonstrates the use of attachment 58. Attachment 58 in a preferred embodiment is another section of resilient, elastic material such as used for stretchable, resilient locator 50. With two ends of the attachment 58 secured to connecting substrate 40, the center of the attachment 58 is free and useful in compressively holding a variety of necessary and useful instrument items. Peg winder 66 is shown held in place by attachment 58, for example. Any other useful items, such as picks and so forth, may be kept with the invention as well.

Figure 7:
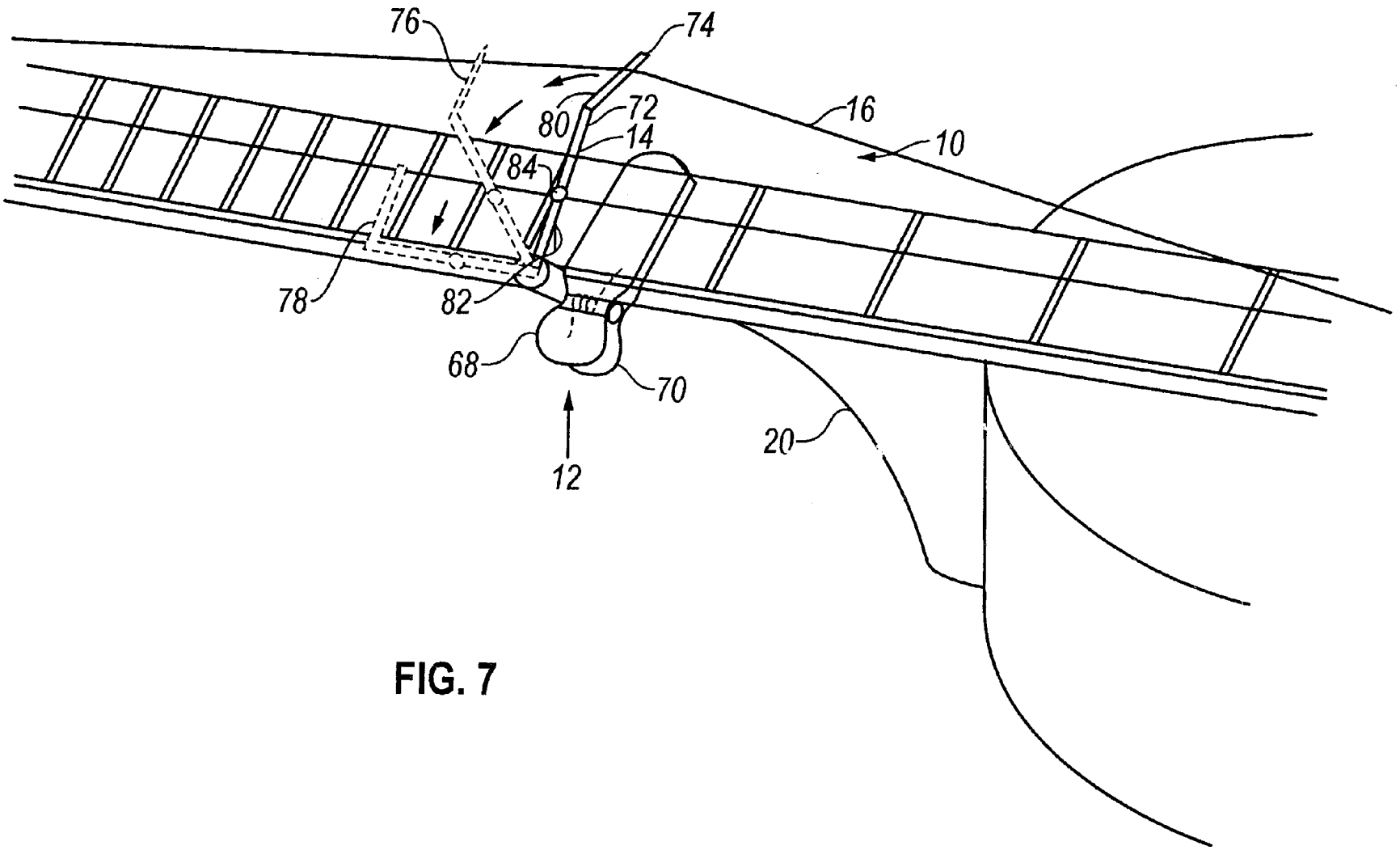
FIG. 7 is a side perspective view of another preferred embodiment of the present invention wherein the resilient extension is in the form of a L-shaped arm and illustrating the collapsing movement of the L-shaped arm as a string is wound around a tuning post.

Referring now to FIG. 7, another preferred embodiment of the present invention is illustrated. In this embodiment the two basic elements of the invention persist: support 12 and resilient extension 14. Here however, support 12 is in the form of a clamp 68. Clamp 68 is removably attachable to instrument 20 and may include a release trigger 70, for opening the clamp 68, as is known in the art.

Connected to clamp 68 is resilient extension 14. In the embodiment shown in FIG. 7, resilient extension 14 is an L-shaped arm 72. L-shaped arm 72 is spring loaded in the up position 74 by any means known in the art. The use of the string assist apparatus 10 of this embodiment is identical to that previously described. After connecting end 18 of string 16 to bridge 22, string 16 is passed over the top of L-shaped arm 72 and connected to the tuning post 26. Winding string 16 around tuning post 26 causes L-shaped arm 72 to be forced downward to intermediate position 76 and finally, once string 16 is properly wound, to collapsed position 78. From there L-shaped arm 72 is held in position by a retaining detent, not shown, or any other suitable means, the release trigger is operated and the invention removed from the instrument 20.

FIG. 7 also illustrates another common feature, the height adjuster 62. In this embodiment, L-shaped arm 72 includes an upper arm 80 and a lower arm 82. Upper arm 80 is conformed to just fit within lower arm 82. Knurled connector 84 is used to compressively secure upper arm 80 at the selected height by twisting knurled connector 84, as is known in the art.

Figure 8:
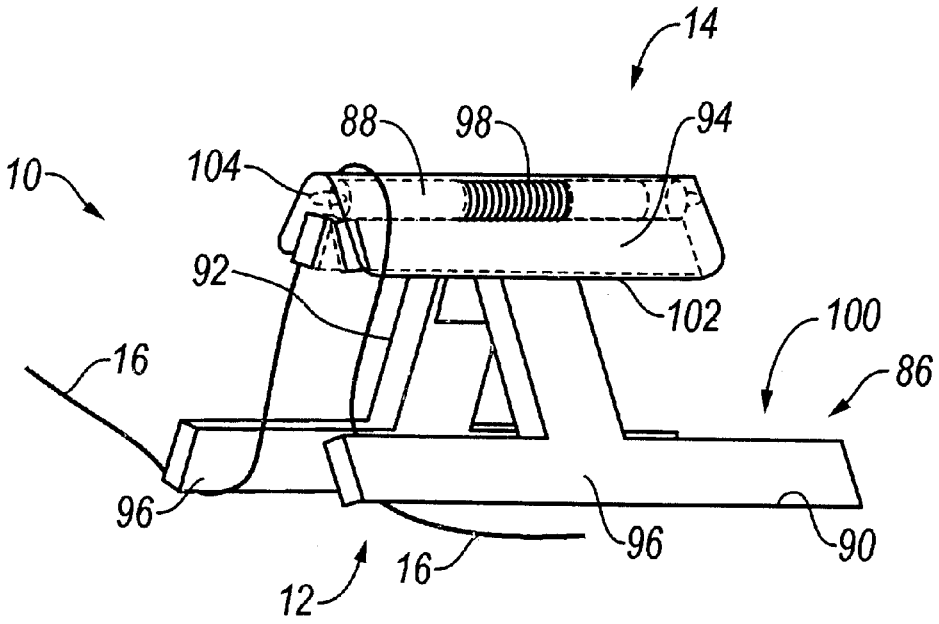
FIG. 8 is a perspective view of another preferred embodiment of the present invention wherein the support and the resilient extension is in the form of an inverted V-shaped wedge.
Figure 9:
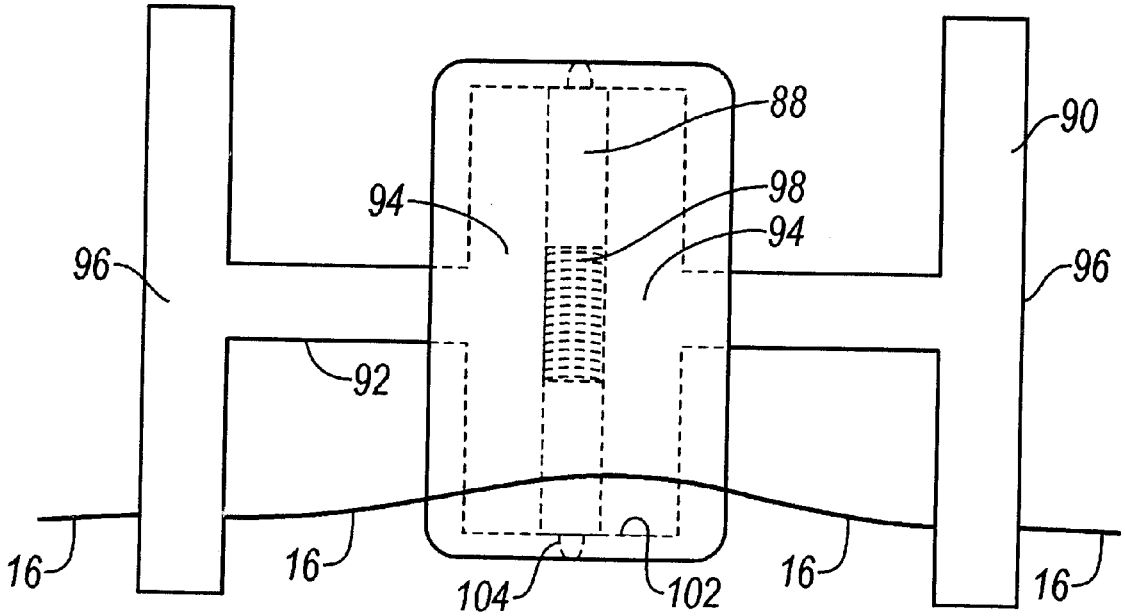
FIG. 9 is a top view of the embodiment of the invention in FIG. 8, shown in the collapsed position.

Referring now to FIGS. 8 and 9, another preferred embodiment of the present invention is illustrated. In this embodiment the two basic elements of the invention persist as well: support 12 and resilient extension 14.

In this embodiment however, support 12 and resilient extension 14 are formed by inverted V-shaped wedge 86. Inverted V-shaped wedge 86 is a spring loaded hinge with an apex 88 and two sides 90 and 92. Sides 90 and 92 are connected at ends 94 to apex 88 and contact instrument 20 at ends 96. Apex 88 is a resilient spring loaded hinge 98 to which both sides 90 and 92 are attached. In use, string 16 passes under one end 96 over apex 88 and under the other end 96 and holds inverted V-shaped wedge 86 in place. As string 16 is wound tight apex 88 is pressed in the direction of arrow 100 and ends 96 are moved away from each other as the inverted V-shaped wedge is flattened.

In other preferred embodiments, apex 88 includes a cover 102 on which string 16 would slide and a spring tension adjuster 104 for adjusting the tension in spring loaded hinge 98. Height adjustment for this embodiment is easily accomplished by providing telescoping legs to sides 90 and 92 as described with L-shaped arrow 72 above.

FIG. 9 shows this embodiment of the invention in the collapsed position, from which the V-shaped wedge is simply slid out from underneath string 16 and the instrument is ready to play.

It should be understood that many variations of the invention are included within the scope of these preferred embodiments. The fundamental requirements are for a support 12 and a resilient extension 14. As illustrated, the support 12 can take the form of expandable base 38 or clamp 68. Other supports 12 are included as is apparent to those of ordinary skill in the art.

Further, resilient extension 14 can take the form of first extension 30 and second extension 32. It can also take the form of L-shaped arm 72.

Further the support 12 and resilient extension 14 can take the form of an inverted V-shaped wedge 86 with resilient apex 88 and sides 90 and 92.

While the present invention has been disclosed in connection with the preferred embodiment thereof, it should be understood, again, that there may be other embodiments which fall within the spirit and scope of the invention as defined by the following claims.

What is claimed is:

1. For instruments with strings, a string changing assist apparatus comprising:

a) a support; and b) a resilient extension connected to said support.

2. The apparatus of claim 1 further comprising a connector for removably attaching said apparatus to said instrument.

3. The apparatus of claim 2 wherein said connector is a pair of hook and loop straps.

4. The apparatus of claim 1 further comprising a height adjuster for said resilient extension.

5. The apparatus of claim 1 wherein said resilient extension is a three sided form with an expandable base.

6. The apparatus of claim 1 wherein said resilient extension is an L-shaped arm.

7. The apparatus and claim 1 wherein said resilient extension is an inverted V-shaped wedge.

8. The apparatus of claim 1 further comprising a height adjuster.

9. The apparatus of claim 1 further comprising an attachment means for removably attaching articles to said apparatus.

10. For instruments with strings, a string changing assist apparatus comprising:

a) a support removably attachable to the instrument; and b) a height adjustable resilient extension connected to the support.

11. The apparatus of claim 10 further comprising an attachment means for removably attaching articles to the apparatus.

12. The apparatus of claim 10 wherein the height adjustable resilient extension is a three sided triangle shaped form with an expandable base.

13. The apparatus of claim 10 wherein the height adjustable resilient extension is an L-shaped arm.

14. The apparatus of claim 10 wherein the height adjustable resilient extension is an inverted V-shaped wedge.

15. The apparatus of claim 10 wherein the removably attachable support further comprises a pair of hook and loop straps.

16. For instruments with strings, a method for assisting the changing of strings comprising the steps of:

a) constructing a support;

b) connecting a resilient extension, moveable between an extended and a collapsed position, to the support;

c) placing the support and resilient extension, in the extended position, on the instrument;

d) attaching one end of a string to the instrument;

e) passing the string over the resilient extension in the extended position;

f) inserting the other end of the string into a tuning post; and g) winding the string around the tuning post under tension from the resilient extension.

17. The method of claim 16 further comprising the step of adding a connector for removably connecting the support to the instrument.

18. The method of claim 17 further comprising the step of constructing the connector from a pair of hook and loop straps.

19. The method of claim 16 further comprising the step of adding a height adjuster to the resilient extension.

20. The method of claim 16 further comprising the step of adding an attachment means for removably attaching articles to the support and resilient extension.

* * * * *